US005845851A

United States Patent [19]

Shfaram

[11] Patent Number: 5,845,851

[45] Date of Patent: Dec. 8, 1998

[54] IRRIGATION HOSE NOZZLE

[75] Inventor: Adi Shfaram, Herzlia Pituach, Israel

[73] Assignee: Netafim Irrigation Equipment and Drip Systems Kibbutz Hatzerim (1973), Negev, Israel

[21] Appl. No.: 788,504

[22] Filed: Jan. 24, 1997

[30] Foreign Application Priority Data

Apr. 3, 1996 [IL] Israel ..... 117818

[51] Int. Cl.[6] ..... B05B 7/02

[52] U.S. Cl. ..... 239/525; 239/530; 239/583; 251/262

[58] Field of Search ..... 239/525, 526, 239/569, 570, 574, 583, 586, 530; 251/262, 263, 251

[56] References Cited

U.S. PATENT DOCUMENTS

| | | | |
|---|---|---|---|
| 3,001,723 | 9/1961 | Bounds | 239/526 |
| 3,022,015 | 2/1962 | Burch . | |
| 3,581,998 | 6/1971 | Roche | 239/525 |
| 3,670,966 | 6/1972 | Korda . | |
| 3,884,419 | 5/1975 | Geoffray | 239/526 |
| 3,967,783 | 7/1976 | Halsted et al. | 239/102 |
| 4,023,715 | 5/1977 | Biondo . | |
| 4,026,470 | 5/1977 | Crist | 239/102 |
| 4,219,162 | 8/1980 | Dadson | 239/583 |
| 4,618,100 | 10/1986 | White et al. | 239/526 |
| 4,629,124 | 12/1986 | Gruber | 239/586 |
| 4,903,897 | 2/1990 | Hayes | 239/525 |
| 5,160,093 | 11/1992 | Battaglia | 239/525 |
| 5,232,162 | 8/1993 | Chih | 239/526 |
| 5,360,172 | 11/1994 | Wang | 239/586 |

FOREIGN PATENT DOCUMENTS

| | | |
|---|---|---|
| 0 251 990 | 1/1988 | European Pat. Off. . |
| 979 385 | 4/1951 | France . |
| 2 536 774 | 6/1984 | France . |
| 2 680 705 | 3/1993 | France . |
| 1 809 514 | 6/1970 | Germany . |
| 24 26 473 | 12/1975 | Germany . |
| 24 51 715 | 5/1976 | Germany . |
| 27 12 426 | 9/1978 | Germany . |
| 28 27 402 | 1/1980 | Germany . |
| 28 43 666 | 4/1980 | Germany . |
| 32 30 247 | 2/1984 | Germany . |
| 426 406 | 10/1964 | Switzerland . |

*Primary Examiner*—Andres Kashnikov
*Assistant Examiner*—Lisa Ann Douglas
*Attorney, Agent, or Firm*—Helfgott & Karas, P.C.

[57] ABSTRACT

A hose nozzle comprising a housing with a water inlet and at least one water outlet and a water duct intermediate the water inlet and each of the at least one water outlet and a flow regulator associated with each water outlet and is operable between a closed position in which water flow is prohibited and an open position in which water flow is admitted. Each flow regulator is provided with an adjustable activator on a surface of the housing.

16 Claims, 6 Drawing Sheets

IRRIGATION HOSE NOZZLE

FIELD OF THE INVENTION

The present invention is in the field of irrigation equipment and more specifically it is concerned with a nozzle of the type typically attached at a free end of a flexible hose. Pistol nozzles, hose nozzles and spray nozzles are collectively referred to as "hose nozzles".

BACKGROUND OF THE INVENTION

Hose nozzles of the specified type have long been known and are used for mounting on a free end of a garden hose for the purpose of emitting a water jet or spray at a desired discharge rate and at a suitable pattern. It may, for example, be required to use a sharp and strong water jet for rinsing a concrete or paved surface, or to use a gentle shower for irrigating a flower bed or a fan-like shaped spray for irrigating a lawn or a powerful wide jet which may be used for distant irrigation.

The so called "pistol" or "spray" nozzles typically comprise a body having a shape resembling that of a pistol and comprising a water inlet connected to a hose, a water outlet and an activator, usually being in the form of a lever or a trigger. In some cases, the water outlet comprises a rotatable head comprising several discharge patterns which may be rotated so that a desired pattern faces the water outlet.

A serious drawback of such hose nozzles is that they require manually retaining of the activator for controlling the water discharge rate, and they usually employ a biasing spring against which force should be constantly applied. It is known to use a locking member e.g. in the form of a ratchet mechanism or an adjustable screw, however such means require using both hands of the operator for locking or releasing. Furthermore, in case of a rotatable head, only one pattern may be used at a time, and again, two hands are required for changing positions of the head to obtain a different irrigation pattern.

It is the object of the present invention to provide a new and improved hose nozzle wherein the above-referred to disadvantages are significantly reduced or overcome.

SUMMARY OF THE INVENTION

According to the present invention there is provided a hose nozzle comprising a housing with a water inlet and at least one water outlet and a water duct intermediate said water inlet and each of said at least one water outlet; a flow regulator associated with each water outlet and being operable between a closed position in which water flow is prohibited and an open position in which water flow is admitted; each flow regulator being provided with an adjustable activator on a surface of the housing.

In a preferred embodiment of the invention, the flow regulator consists of a first chamber in flow communication with a water inlet side of the water duct and a second chamber in flow communication with the water outlet side of the water duct, with a sealing port intermediate said chambers; and a piston being displaceable between a closed position in which water flow between the chambers is prohibited and an open position in which water flow between the chambers is admitted.

The piston of the flow regulator comprises a portion projecting through an opening in one of the chambers and being, engageable with the adjustable activator.

According to a specific application of the invention, the sealing port between the chambers is a necking portion and preferably the sealing port is encircled by a resilient seal.

In still a preferred embodiment, the adjustable activator is a slide accommodated in the housing and engageable with the piston for transmitting axial displacement to the piston upon displacement of the slide between a first and a second position and wherein the adjustable activator may be retained at any position. In a specific embodiment, one of a portion of the slide and a portion of the housing opposite the respective portion of the slide comprises a serrated surface and the other of the portion of the slide and the portion of the housing comprises a matching projecting tooth or toothed surface for releasable engagement with the serrated surface, whereby the slide may be releasably retained at any location between the first and second positions thereof.

In order to impart axial displacement to the piston, the slide has an inclined path adapted for engaging the projecting portion of the piston, depending on the relative position of the inclined path with respect to the piston.

By one application of the invention, the piston is supported in the chamber by a resilient gasket biasing the piston to its open position and sealing the opening of that chamber. The arrangement is such the resilient gasket operates as a dynamic sealing member wherein biasing of the piston and sealing of the chamber are improved by aid of water applying pressure on the gasket.

Preferably, the second chamber is positioned essentially above the first chamber and wherein the piston is supported in the second chamber and projects from a top wall of the second chamber, said resilient gasket also serving for sealing the opening in the chamber through which the piston projects.

According to one embodiment of the invention, the hose nozzle comprises a single water outlet with an adjustable spout mounted thereon for adjusting the discharge rate and pattern of the water emitted. By another embodiment of the invention, the hose nozzle comprises at least two water outlets, each having a spout for emitting water at a different pattern, e.g. a gentle shower, a sharp jet, a wide stream, etc.

In a preferred application of the invention all the first chambers are in flow communication with one another and a common resilient seal is provided between the first and second chambers of the adjacent flow regulators.

According to the embodiment comprising more than one water outlet, it is possible to have more than one flow regulator in an open position, simultaneously, whereby it is possible to obtain combined water patterns and at varying ranges, e.g. a shower for irrigating at the short distance and a jet for irrigating at a larger range, etc.

Preferably, the spouts of the water outlets are replaceable and the water inlet end of the duct comprises a hose connector, as known per se.

BRIEF DESCRIPTION OF THE DRAWINGS

For better understanding, the invention will now be described by way of example only, with reference to the accompanying drawings in which.

DETAILED DESCRIPTION OF SPECIFIC EMBODIMENTS

Figure 1:
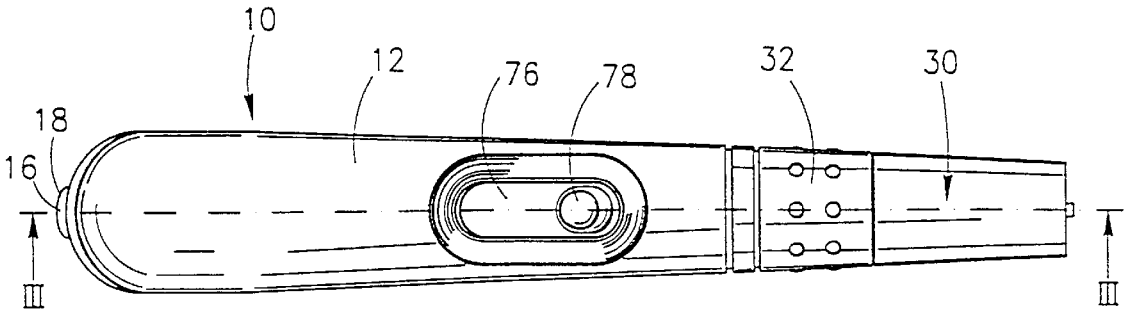
FIG. 1 is a top view of a first embodiment of a hose nozzle according to the present invention comprising a single outlet spout.
Figure 2:
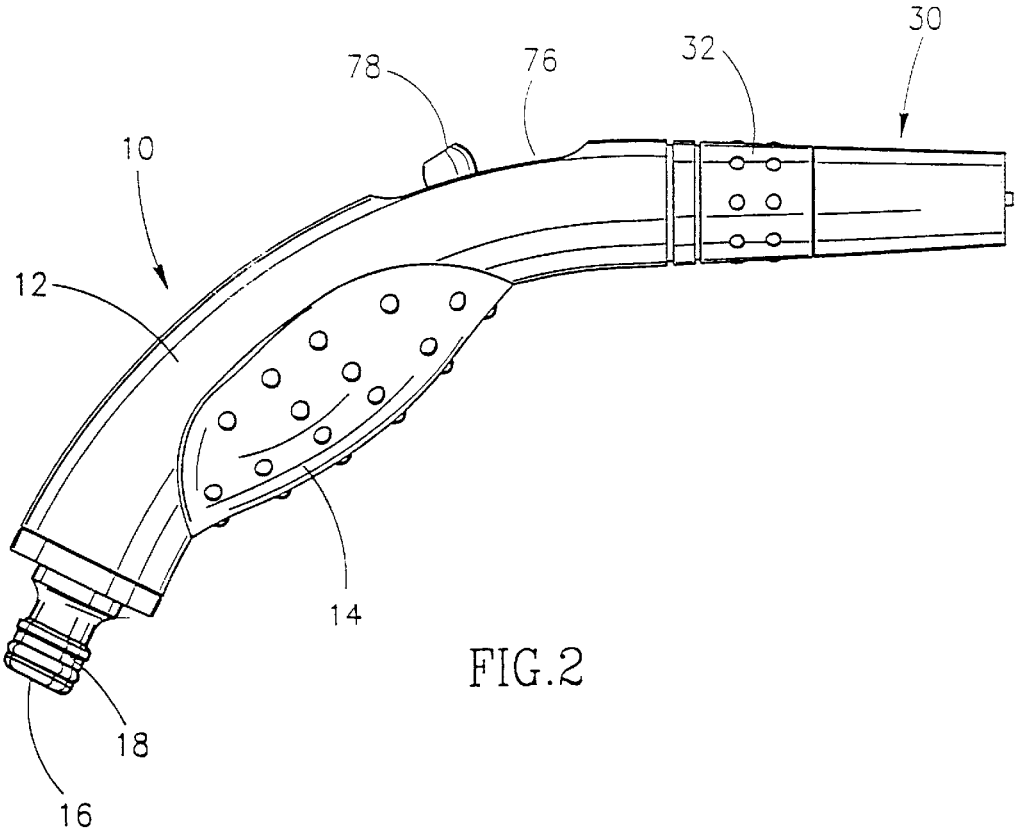
FIG. 2 is a side view of the hose nozzle of FIG. 1.
Figure 3:
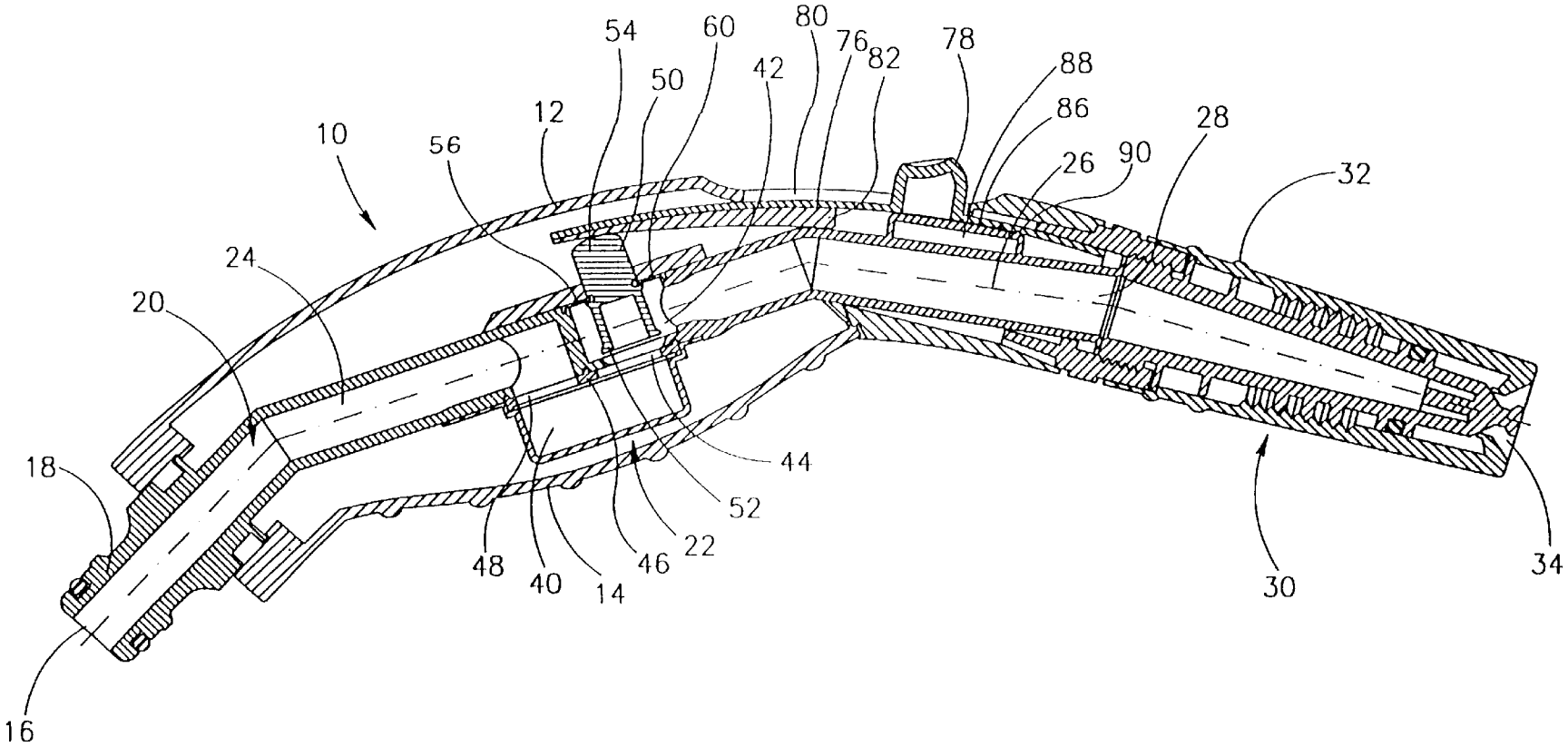
FIG. 3 is a cross-sectional view along line III—III in FIG. 1.

Attention is first directed to FIGS. 1 to 3 of the drawings directed to a first embodiment of the invention which is a single outlet hose nozzle. An ergonomically designed housing generally designated 10 has a gripping portion 12 with a bulged surface 14 for improved gripping.

The housing 10 further comprises an inlet 16 for water ingress, provided with a standard hose snaptype connector 18 connected to a duct generally designated 20 and being supported within the housing 10. The duct 20 is divided by a flow regulator generally designated 22 into an inlet portion 24 and an outlet portion 26, the later having an outlet 28 screw fitted with an adjustable spout 30, whereby rotating a grip ring 32 brings about changing the cross-sectional area of the discharge nozzle 34 for controlling the water discharge pattern, as known per se.

Figure 4:
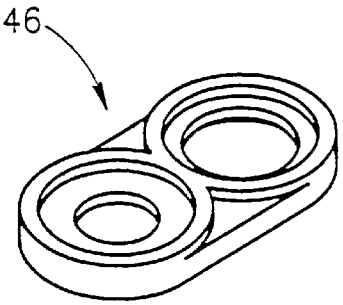
FIG. 4 is an isometric view of a seal used in the embodiment of FIGS. 1 to 3.

The flow regulator 22 consists of a bottom chamber 40 being in flow communication with the inlet portion 24 of the duct 20 and a top chamber 42 above the bottom chamber 40 and being in flow communication with the outlet portion 26 of the duct 20. Intermediate the top and bottom chambers there is a necking sealing port 44 and a resilient seal 46 having an eight-like shape as seen in FIG. 4, encircling both the sealing port 44 and the passage 48 between the bottom chamber 40 and the inlet portion 24 of the duct 20.

A piston 50 is mounted in the top chamber 42 having at a bottom end thereof a sealing ring 52 suitable for sealing engagement with the sealing port 44 as will hereinafter be explained, and a stem 54 projecting through an opening 56 in the top chamber 42. The piston 50 is supported in the top chamber by a resilient gasket 60 which serves also for biasing the piston into its uppermost position, as seen in FIG. 3.

An activating slide 76 is supported in the housing by suitable grooves (not seen) and adapted for sliding within the housing 10 having a knob 78 projecting through a slot 80 in the housing 10. A bottom face of the activator 76 has an inclined ramp 82 slidingly engaging the top end of the stem 54 of the piston 50. A ridged projection 86 is provided on bed 88 integral with the outlet portion 26, slidingly supporting the activating slide 76, the ridged projection 86 adapted for snapping engagement with any of a plurality of recesses 90 provided at the front of the activating slide on a bottom face, for arresting the slide.

The arrangement is such that displacing the activating slide 76 by sliding the projecting knob 78 rearwardly, entails gradual axial displacement of the piston 50 downward, whereby the cross-sectional area of the sealing port 44 decreases or entirely closes, whereby water flow between the chambers is prohibited. The activating slide may be set at any intermediate position resulting in change of the water discharge. Changing position of the slide is by applying gentle pressure on the knob 78 for releasing the ridged projection 86 and sliding the activator within the slot 80.

The construction of the resilient gasket 60 is such that it serves as a dynamic seal, whereby pressure applied by the water on the bottom surface of the gasket 60 tensions the gasket and thus improves the sealing of the opening 56 and assists in the upward biasing of the piston 50.

Figure 9:
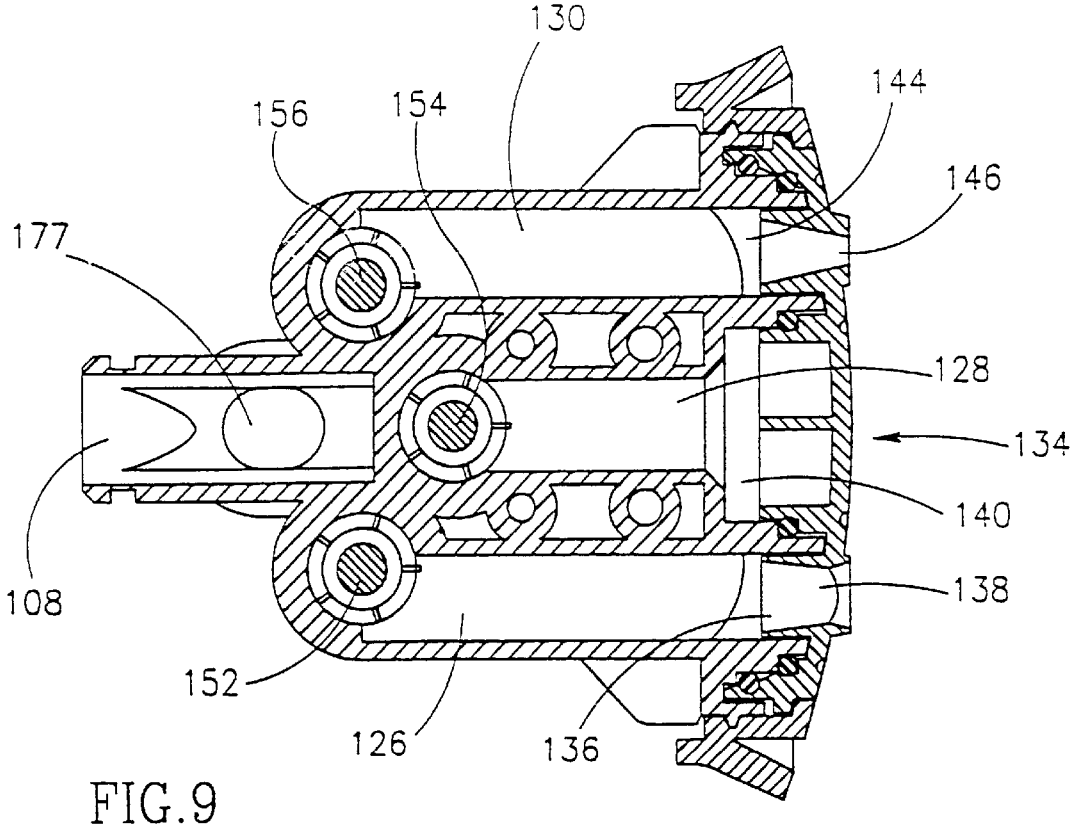
FIG. 9 is a cross-sectional view taken along line IX—IX in FIG. 8 of the drawings, illustrating a front portion of the hose nozzle according to the present invention, with the housing removed.
Figure 5:
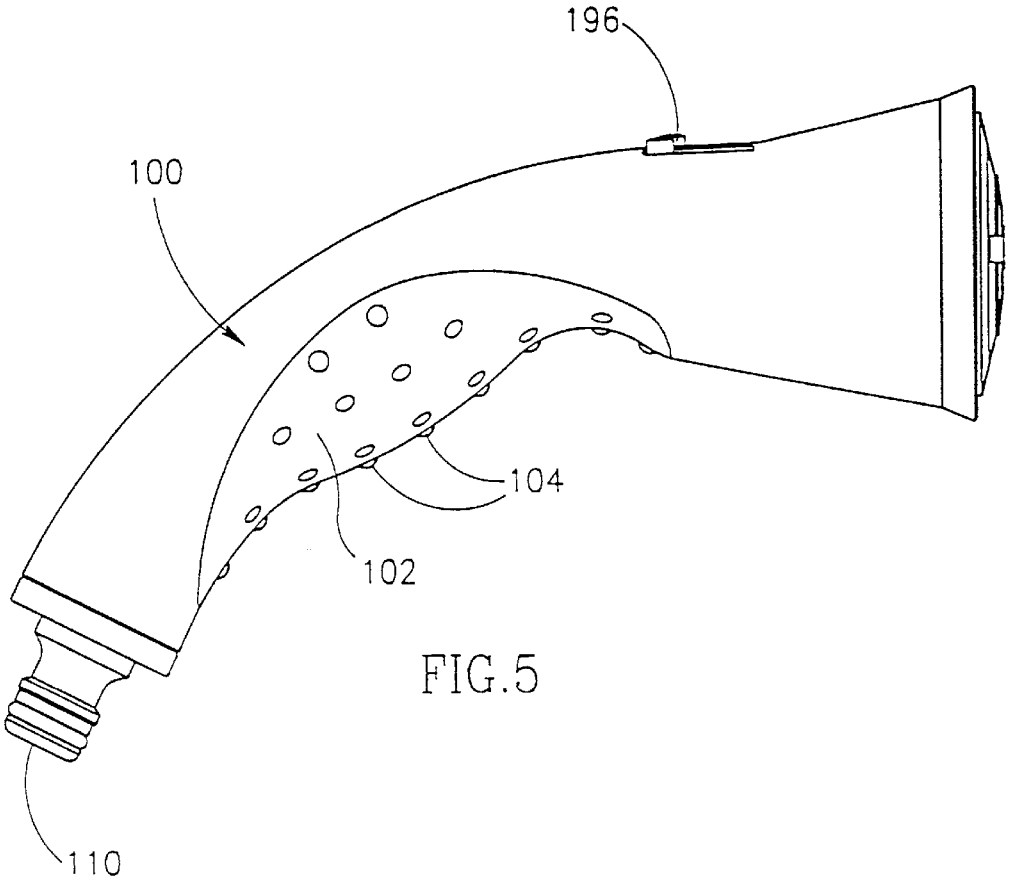
FIG. 5 is a side view of a second embodiment of a hose nozzle according to the invention comprising three outlet spouts.
Figure 6:
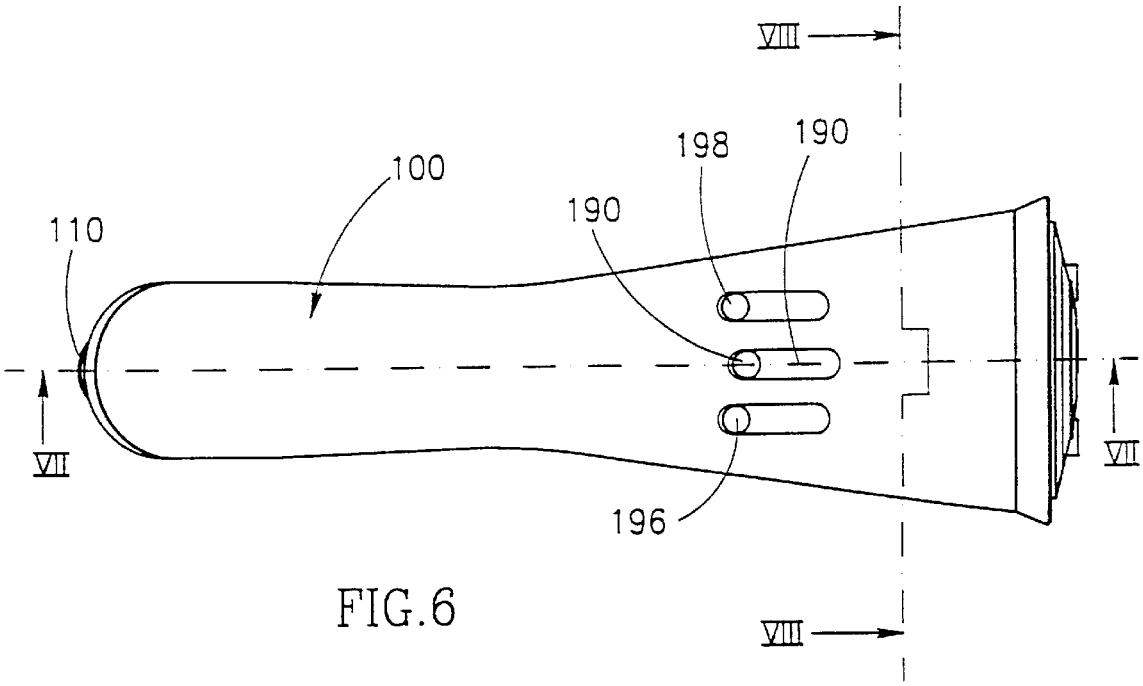
FIG. 6 is a top view of the hose nozzle seen in FIG. 5.
Figure 7:
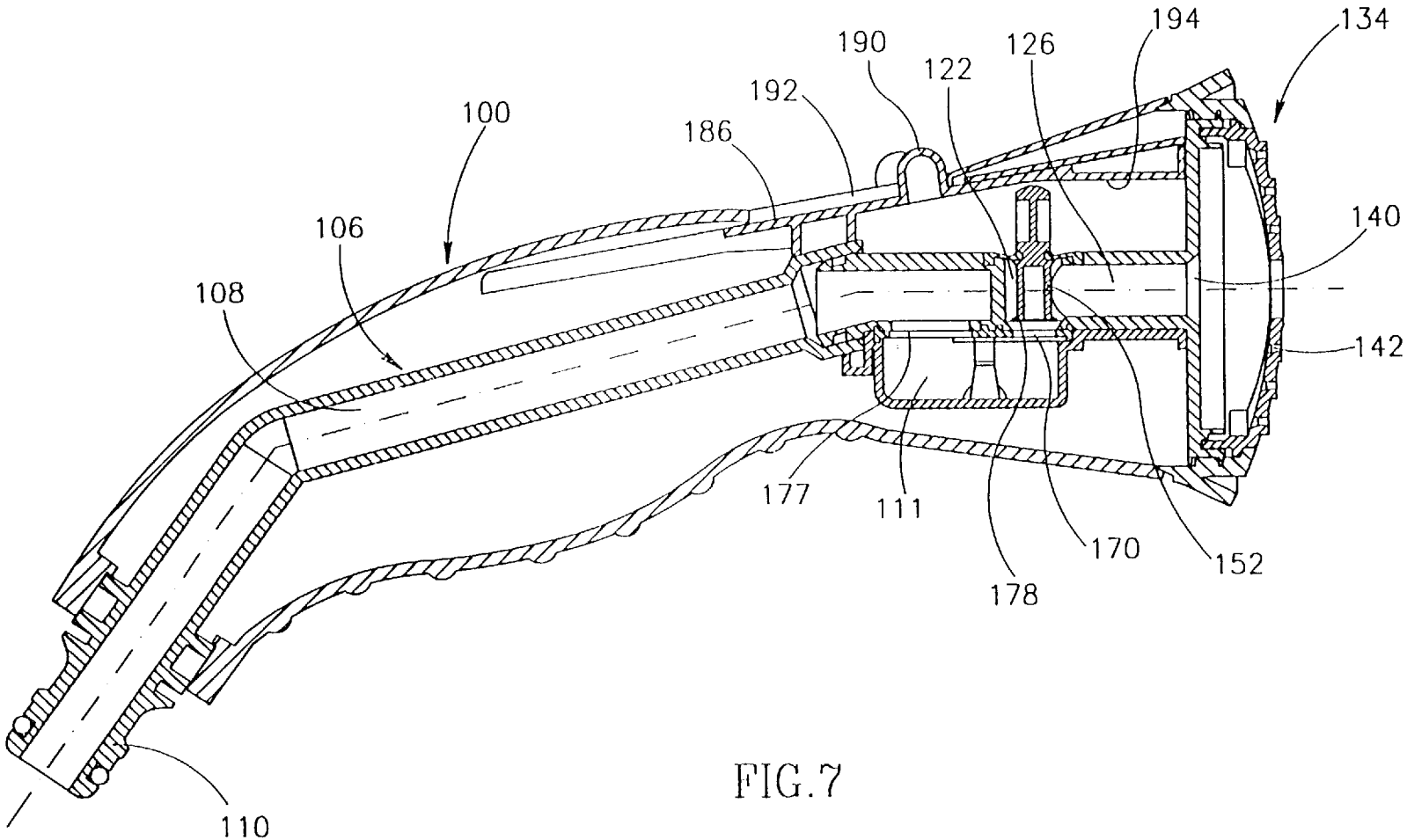
FIG. 7 is a cross-sectional view taken along line VII—VII in FIG. 6, illustrating a hose nozzle according to the present invention comprising three water outlets.

Attention is now directed to FIGS. 5 to 7 of the drawings illustrating a second embodiment of the hose nozzle according to the invention. As in the previous embodiment, the hose nozzle has a housing 100 with an ergonomic design and comprises a gripping portion 102 with a plurality of bulges 104. The hose nozzle further comprises a duct Generally referred to at 106 having an inlet portion 108 with a hose connector 110 at its rear end. The inlet portion 108 of the duct 106 leads to a bottom chamber 111 of three flow regulators generally designated at 112, the bottom chamber is provided with three compartments 114, 116 and 118,(seen in FIG. 8), all three compartments being in flow communication with one another. Top chambers 120, 122 and 124 are located above each respective bottom compartment of the bottom chamber 111, each top chamber being associated with an outlet portion 126, 128 and 130 respectively, as seen in FIG. 9. A distribution head 134 is secured to the front end of the housing 100 having an opening opposite each of the outlet portions 126, 128 and 130. A first opening 136 leads to a wide stream spout 138, a second opening 140 opposite outlet 128 leads to a gentle shower discharge grid plate 142 and a third opening 144 (see FIG. 9) opposite outlet 130 leads to a narrow jet stream spout 146.

Figure 8:
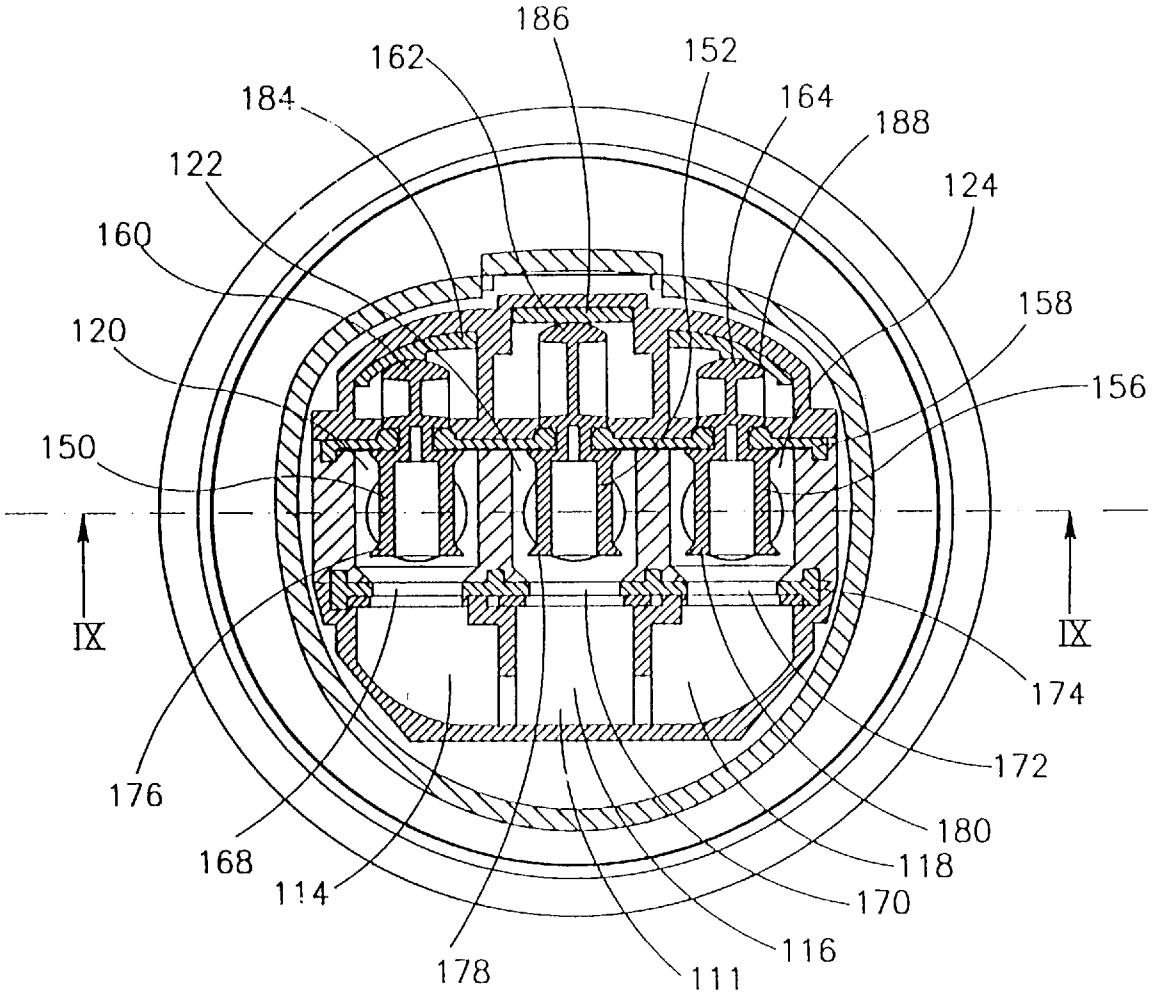
FIG. 8 is a cross-sectional view taken along line VIII—VIII in FIG. 6.

Similar to the arrangement described with regard to the first embodiment, each of the top chambers 120, 122 and 124 of the flow regulators 112 accommodates a piston 150, 152 and 156 respectively, each of the pistons being supported by a resilient gasket 158 which serves also for sealing the openings at the top chambers through which a stem 160, 162 and 164 of each of the pistons projects, and also for biasing the pistons upwardly, to the position seen in FIG. 8.

Figure 10:
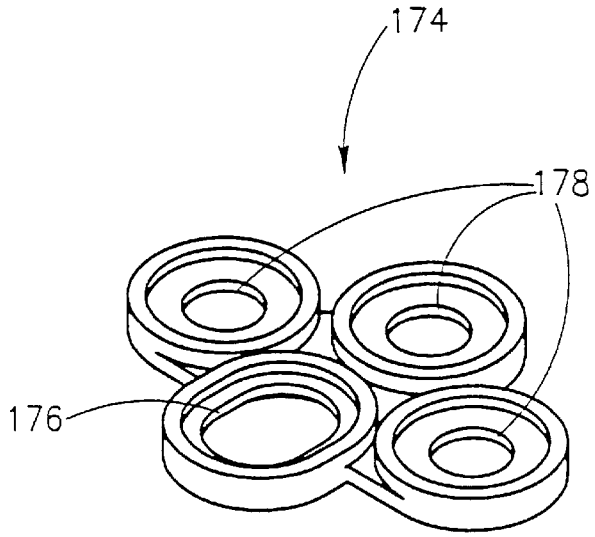
FIG. 10 is an isometric view of a seal used with a hose nozzle according to the second embodiment of the invention comprising three outlet nozzles.

As seen in FIGS. 7 and 8 of the drawings, between each of the top chambers 120, 122 and 124 and the bottom compartment of chamber 111, there is a sealing port 168, 170 and 172, respectively. A resilient seal 174, seen in perspective view in FIG. 10, has four openings, a first opening 176 for sealing opening 177 between the bottom chamber 111 and the inlet portion 108 of the duct 106 and three other openings 178, each encircling the sealing ports 168, 170 and 172.

Each of the pistons 150, 152 and 156 has a sealing portion 176, 178 and 180, respectively, adapted for sealing engagement with the respective sealing ports 168, 170 and 172.

Each of the flow regulators 112 comprises an adjustable activator 184, 186 and 188 provided over each of the piston stems 160, 162 and 164, respectively, for sliding engagement therewith, as already explained with reference to the first embodiment of the invention.

As seen in FIG. 7, a slide 186 has an operating knob 190 projecting through a slot 192 in the housing 100, the slide having at a front end thereof an inclined ramped surface 194 adapted for sliding engagement with the piston stem 162, whereby rearward displacement of the activating slide 186 entails axial displacement of the piston 152 downward, whereby the cross-sectional area of the seal port 170 gradually decreases until it is completely sealed by the sealing portion 178 of the piston 152. The two other flow regulators operate in a similar manner so as to control the water flow through their respective sealing ports 168 and 172, controlled by activating slides 196 and 198, respectively (seen in FIG. 6).

The arrangement is such that each of the flow regulators 112 may be set at any position regardless of the position of the other flow regulators, whereby combined water patterns may be obtained the discharge and range of watering determined by the amount in which each of the flow regulators is opened.

It should be readily understood that in this embodiment too, arrangements may be provided for retaining the activating slides at any required position.

I claim:

1. A hose nozzle comprising a housing with a water inlet and at least one water outlet and a water duct intermediate said water inlet and at least one water outlet and a flow regulator associated with each water outlet; each flow regulator comprising a first chamber being in flow communication with a water inlet side of the water duct and a second chamber positioned essentially above the first chamber and being in flow communication with the water outlet side of the water duct, with a sealing port intermediate said chambers; and a piston supported within the second chamber and projecting from a wall of the second chamber being displaceable between a closed position in which said sealing port is closed where water flow between the chambers is prohibited, and an open position in which said sealing port is open and water flow between the chambers is admitted; and an adjustable piston activator on a surface of the housing.

2. A hose nozzle according to claim 1, wherein the piston comprises a portion projecting through an opening in one of the chambers and being engageable with the adjustable piston activator.

3. A hose nozzle according to claim 2, wherein the piston is supported in the chamber by a resilient gasket biasing the piston to its open position and sealing the opening of the chamber.

4. A hose nozzle according to claim 1, wherein the sealing port between the chambers is a necking portion.

5. A hose nozzle according to claim 4, wherein the sealing port is encircled by a resilient seal.

6. A hose nozzle according to claim 5, wherein a common resilient seal is provided between the first and second chambers of adjacent flow regulators.

7. A hose nozzle according to claim 1, wherein the adjustable piston activator is a slide accommodated in the housing and engageable with the piston for transmitting axial displacement to the piston upon displacement of the slide between a first and a second position.

8. A hose nozzle according to claim 7, wherein the slide has an inclined path adapted for engaging the piston and imparting axial displacement thereto, depending on the position of the inclined path with respect to the piston.

9. A hose nozzle according to claim 1, wherein the adjustable piston activator may be retained at any position.

10. A hose-nozzle according to claim 9, wherein one of a portion of the slide and a portion of the housing opposite the respective portion of the slide comprises a serrated surface and the other of the portion of the slide and the portion of the housing comprises a matching projecting tooth or toothed surface for releasable engagement with the serrated surface, whereby the slide may be releasably retained at any position thereof.

11. A hose nozzle according to claim 1, wherein the water inlet end of the duct comprises a hose connector.

12. A hose nozzle according to claim 1, comprising a single water outlet with an adjustable spout mounted thereon.

13. A hose nozzle according to claim 1, comprising at least two water outlets, each having a spout for emitting water at a different pattern.

14. A hose nozzle according to claim 13, wherein the spouts are replaceable.

15. A hose nozzle according to claim 1, wherein all the first chambers are in flow communication with one another.

16. A hose nozzle according to claim 1, wherein more than one flow regulator may be in the open position simultaneously.

* * * * *